US006286440B1

(12) United States Patent
Jyringi

(10) Patent No.: US 6,286,440 B1
(45) Date of Patent: Sep. 11, 2001

(54) COMPUTER IN A DESK

(76) Inventor: Craig Jyringi, 5 Foster St. P.O. Box 78, Rochdale, MA (US) 01542

( * ) Notice: Subject to any disclaimer, the term of this patent is extended or adjusted under 35 U.S.C. 154(b) by 0 days.

(21) Appl. No.: 09/506,883

(22) Filed: Feb. 18, 2000

(51) Int. Cl.[7] ..... A47B 37/00
(52) U.S. Cl. ..... 108/50.01; 108/9; 312/223.3
(58) Field of Search ..... 108/50.01, 50.02, 108/9, 6; 312/223.3, 208.1, 196, 194, 231, 313, 7.2; 248/917

(56) References Cited

U.S. PATENT DOCUMENTS 4,735,467 * 4/1988 Wolters ..... 312/223.3
5,452,950 * 9/1995 Crenshaw et al. ..... 312/223.3
5,896,817 * 4/1999 Hancock ..... 108/50.01
5,957,059 * 9/1999 Burhman ..... 312/223.3
6,022,087 * 2/2000 Gilbert ..... 312/223.3
6,059,385 * 5/2000 Guhl ..... 312/223.3
6,092,883 * 7/2000 Lechman ..... 312/223.3

* cited by examiner

*Primary Examiner*—Peter M. Cuomo
*Assistant Examiner*—Jerry A. Anderson

(57) ABSTRACT

A school, home or commercial desk that can be used for traditional tasks and yet provides readily available access to computer equipment. The computer in a desk (10) is comprised of a desk body (24) that houses the internal components of a standard computer; a desk top (12) that houses the flat panel screen (18) beneath a view panel (20) that is mounted flush with the surface of the desk top (12); a keyboard tray (14) that holds the standard computer keyboard; and a support system of four adjustable legs (42). The desk top (12), keyboard tray (14), and legs (42) are all adjustble to suit the users specific ergonomic needs. The desk body (24) consists of a front panel (28), back panel (30), right side panel (32),and left side panel (34), bottom panel (36), and top panel (38) that give the computer in a desk (10) its shape, support and access to available, installed computer components. Furthermore, the computer in a desk (10) can be used for traditional and computer related tasks regardless of the user adjusted.

14 Claims, 6 Drawing Sheets

COMPUTER IN A DESK

CROSS REFERENCES TO RELATED APPLICATIONS

Not Applicable

BACKGROUND

1. Field of Invention

Machine/electronics:

This invention relates to computers, specifically to an integrated computer system and desk.

2. Description of Prior Art

This invention relates to computer desks for use in schools and homes. Although the specifications and descriptions of said desk relate specifically to a classroom application, it can readily by used in a home consumer and commercial setting.

The versatility of this invention allows school districts to purchase and build a computer lab within a classroom without sacrificing valuable building space. Typically, schools have computer labs or computer rooms which are dedicated solely to computer use. Such computer rooms often have one or more long tables on which two or more computers are placed. The computer rooms are an integral part of the school yet they must be reserved by individual classes ahead of time. The students must leave their classroom and travel to the computer room losing valuable learning time in the process. The time lapse between the delivery of the lesson to the time when they can pursue the objectives on a computer is detrimental to the students learning.

Therefore, it is desirable to incorporate the computer into the desk itself. The student might need to access the internet, assemble reference materials, prepare a written outline, and then use a computer word processor to write a document during which the the outline might have to be modified and reference materials and online access used repeatedly. All of this is available from the desk top with the integrated computer desk.

Through the use of the "Computer in a Desk" school districts can outfit any classroom with 21st century technology. Literally, students will have the world at their finger tips. Teachers will no longer need to reserve the computer lab for their classes. Students will no longer have to wait to research a topic or locate information. At a time when educational reform is a buzz word in our society and budgets are being cut, the "Computer in a Desk" solves a myriad of technological, curricula and budgetary related issues.

Patent Search:

Several patents depict computer equipment stored within a desk. None of the patents indicate a computer system/flat panel screen as one integrated unit. All of the patents indicate where and how existing computer equipment can be placed in and on their desks.

U.S. Pat. No. 4,766,422 to Wolters; Richard H.(Grand Rapids Township, Kent County, Mich.); Kleyla; Vince (Phoenix, Ariz.); Hooton; Arnold J.(Caledonia Township, Kent County, Mich.); Converse; Gregory L. (Wyoming, Mich.) (Aug. 23, 1988) depicts a desk with a standard computer system case and monitor. When the computer equipment is in use, either some or all of the desktop space that could be used for traditional tasks, such as writing, is extremely limited, made inaccessible or not at a comfortable height. In addition, before such desks can be converted into computer workstations, the working materials on the surface of the desks must be cleared away from the main work area which is time consuming and inconvenient. A student using this kind of desk in a school would have a difficult time using the technology.

U.S. Pat. No. 5,611,608 to Clausen; Mark (R.R. 2, Box 196, Wild Rose, Wis. 54984) (Mar. 18, 1997) depicts a desk with a standard computer system case and monitor. This desk is designed with an "L" shape work area an two levels. This "L" shape configuration limits the work area as well as contributing, to a setup problem for the student and teacher.

U.S. Pat. No. 5,957,059 to Burhman; Gary (27 E. Sherwood Dr., Overland, Mo. 63119) (Sep. 28, 1999) depicts a desk with a standard computer system case and monitor. The monitor is placed below the desk top. A hinged panel needs to be manipulated in order for the user to see the viewable surface of the monitor. The monitor cover may cause a student difficulty in access, requiring help from the classroom teacher. Student materials need to be removed from the desktop in order to operate the panel covering the monitor. The recessed monitor makes it difficult for the student or teacher to reach the monitor adjustment dials. The monitor is in a fixed position making ergonomic adjustments impossible. The student/user will need to adjust desk/chair height in order to view the monitor screen comfortably.

U.S. Pat. No. 5,655,822 to Roberts; Fay D. (1821 E. Winchcomb Dr., Phoenix, Ariz. 85022); Williamson; Debra D. (1909 E. Presidio Rd., Phoenix, Ariz. 85022) (Aug. 12, 1997) depicts a desk with a standard computer system case and monitor. The trapezoidal desk limits placement of desks in the classroom to modules or clusters. The monitor and computer system is suspended below the desk. The monitor is placed under a viewing "window" at a set angle, making it ergonomically unsound. The viewing screen itself is susceptible to glare from the flourescent lighting found in most classrooms.

U.S. Pat. No. 5,661,633 to Patret; Jean-Marc (Vincennes, FR) (Aug. 26, 1997) refers to a computer device that consists of a thin flat housing with a viewable screen in the center of it. This device occupies desktop space and its durability and usability in a classroom situation is questionable.

U.S. Pat. No. 5,797,666 to Park; Kwang-soo (317-22, Kalhyon-dong, Unp'yong-gu, Seoul, KR) (Aug. 25, 1998) U.S. Pat. No. 5,746,489 to Moon; Jae-Nyun (803 Jiwol-ri, Chowol-myun, Kyungki-do,KR) (May 5, 1998) U.S. Pat. No. 5,967,631 to Ko; Wen-Shan (P.O. Box 23487, Changhua City 500, TW) (Oct. 19, 1999) depicts a desk with a standard computer system case and monitor. The monitor must be lowered or lifted into a usable position thereby using valuable desk top space. In the classroom a student, especially in elementary school, may have difficulty in articulating the monitor to a usable ergonomic position no matter the method or means of articulation.

Industry related search:

1. LearningLine by Engineered Data Products/ The Holt Company (Jan. 01, 1999)
2. T-Leg Computer Table by Heidt Products Inc. (Jan. 1, 1999)
3. Ergonomic Computer Table by Grafco, Inc (Jan. 1, 1999)
4. Ergo Table by Grafco, Inc. (Jan. 1, 1999)
5. "Class" Recessed Monitor Desk by Spectrum Industries Inc. (Jan. 1, 1999)

These 5 companies and their computer desk products were found through industry related research such as trade shows, magazine advertisements and trade journals. None of these models provides for a "computer in a desk" integration.

Finally, all of the above computer desks found through either a thorough patent search and/or related industry research have one similar characteristic in that the computer system and monitor are placed in mounting racks or on shelves within the desk. This common thread along with the numerous ergonomic drawbacks, the logistics of purchasing separate computer equipment for each desk, and consideration for who will be using the desks and how the desks will be used all played a role in the development of the "Computer in a Desk" invention.

SUMMARY INCLUDING OBJECTS AND ADVANTAGES

It is desired that the computer system and monitor equipment be physically attached within the desk to free 100% of the desktop for traditional and/or computer activities. It is further stated that the desk size and shape be amenable to a classroom/home user setting by not using large amounts of floor space. The desk will provide a cost effective way for schools and/or consumers to provide users with the necessary tools to access and use the information needed to function in the 21st century.

Objects and Advantages

Accordingly, several objects and advantages of the invention are:

1. Provide a cost effective way to bring computer technology into every classroom/home.
2. Provide a space saving device.
3. Provide an ergonomically sound device.
4. Provide a means of concealing the computer equipment within the desk.
5. Provide readily available access to the computer when the user needs it.
6. Provide a readily available work surface when the computer is not in use.
7. Provide a desk body that is adjustable to the users ergonomic needs.
8. Provide a readily available keyboard and mouse for computer use.
9. Provide a desk that will allow for traditional paper and pencil work in conjunction with or in addition to computer related work.
10. Provide a desk that allows for quick and easy access to the computer system/flat panel screen for maintenance purposes.
11. Provide a sealed and properly ventilated compartment for the computer system equipment to prevent the introduction of contaminants and/or user tampering.
12. Provide a desk that has an adjustable work surface.
13. Provide two spring adjustable hinges for the keyboard tray to make quick and easy access to the computer keyboard.

Still further objects and advantages will become apparent from a consideration of the ensuing description and accompanying drawings.

REFERENCE NUMERALS

Figure 1:
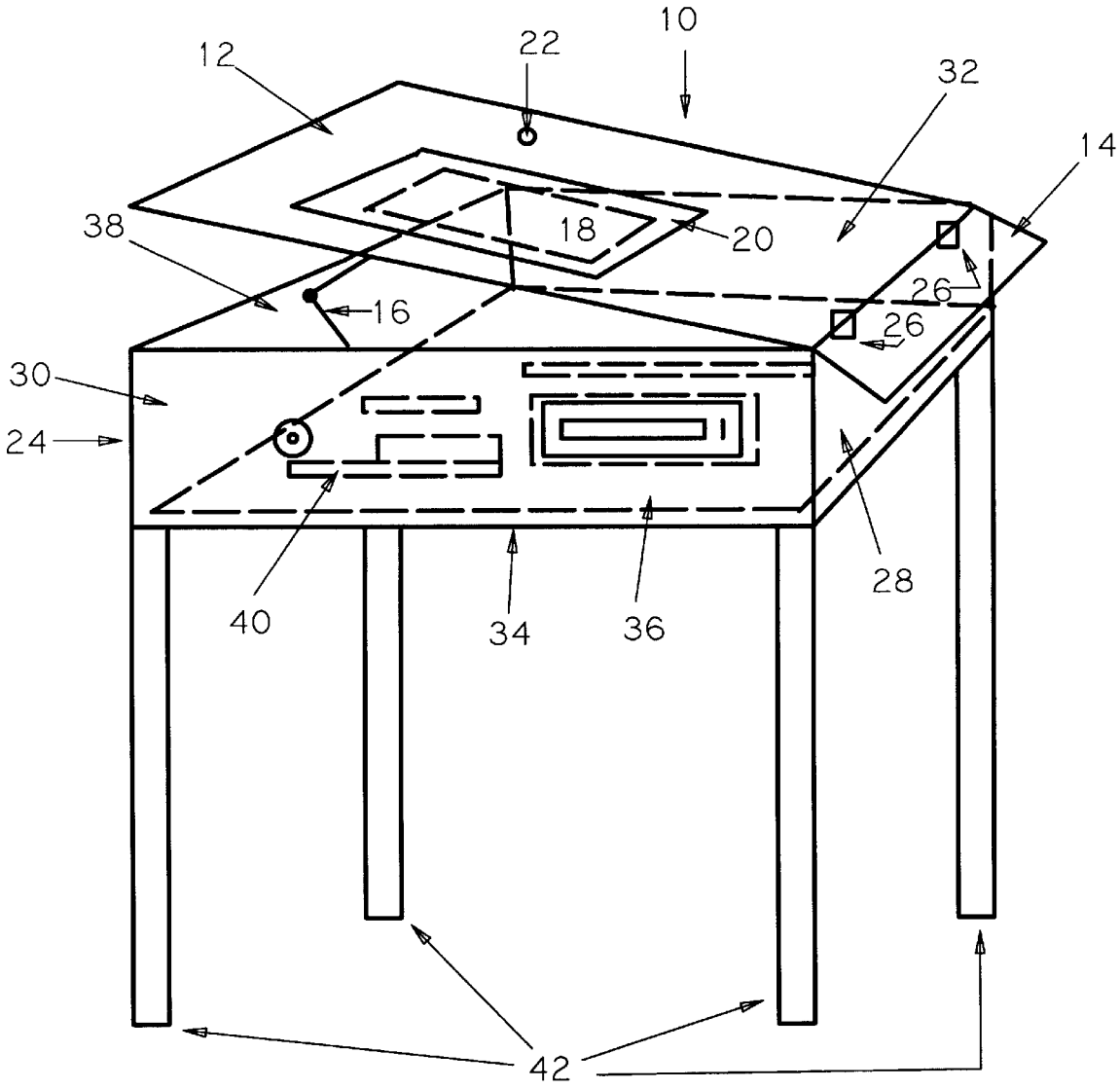
FIG. 1 is a perspective overview depicting the adjustable desk top with recessed flat panel screen and adjustable keyboard tray with the desk body housing the computer components.

10 computer in a desk
12 desk top
14 keyboard tray
16 support brackets
18 flat panel screen
20 view panel
22 mouse access port
24 desk body
26 two spring adjustable hinges
28 front panel
30 back panel
32 right side panel
34 left side panel
36 bottom panel
38 top panel
40 computer system hardware
42 legs
44 power supply
46 on/off switch
48 computer motherboard
50 expansion cards
52 floppy disk drive
54 hard drive
56 cd-rom drive
62 serial port
64 parallel port
66 ps/2 mouse port
68 reset button
70 power button

SUMMARY

It is desired that the computer system and monitor equipment be physically attached within the desk to free 100% of the desktop for traditional and/or computer activities. It is further stated that the desk size and shape be amenable to a classroom/home user setting by not using large amounts of floor space. The desk will provide a cost effective way for schools and/or consumers to provide users with the necessary tools to access and use the information needed to function in the 21st century.

PREFERRED EMBODIMENT—DESCRIPTION

The following detailed description illustrates by way of example how one skilled in the art will be able to make and use the invention.

FIG. 1 is a perspective overview of the computer in a desk 10. The computer in a desk is depicted with the desk top 12 in an open and adjusted position via the two support brackets 16. The support brackets 16 allowing a horizontal adjustment for the traditional paper and pencil work to as much as a forty five degree angled adjustment for computer workstation use. FIG. 1 depicts the desk top 12 in the adjusted, forty five degree position. The desk top 12 of the computer in a desk 10 is usable as a computer workstation when in the horizontal position. The support brackets 16 allow for a zero to forty five degree adjustment by the user for ergonomic viewing convenience. The desk top 12 houses the flat panel screen 18 which is attached to the bottom of the desk top 12. A glass view panel 20 is attached over the flat panel screen 18 to the top side of the desk top 12 to provide protection to the flat panel screen 18. The four sides of the view panel 20 are flush with the desk top 12 and the upper surface of the view panel 20 is level with the surrounding desk top 12 to provide the user a smooth surface on which to perform the traditional paper and pencil work. The desk top 12 provides a mouse access port 22 through which a computer mouse cable can be routed and attached to the appropriate peripheral device. The keyboard tray 14 is shown in the open and adjusted position. The keyboard tray 14 is attached to the desk body 24 with two spring adjustable hinges 26. The two spring adjustable hinges 26 are attached to the bottom of the keyboard tray 14 and the top of the front panel 28 of the desk body 24. The keyboard tray 14 allows for a perpendicular closed positon when it is folded down and away from the user. The computer keyboard can be temporarily mounted to the keyboard tray 14 for easy removal allowing for maintenance, storage, and/or replacement. The two spring adjustable hinges 26 on the keyboard tray 14 can be adjusted from a one hundred eighty degree perpendicular position to a ninety degree horizontal position allowing for the users ergonomic preference. FIG. 1 shows the keyboard tray 14 in the adjusted forty five degree position. The desk body 24 is based on the traditional rectangular student desk design used throughout schools world-wide.

The desk body 24 is comprised of a front panel 28, back panel 30, right side panel 32, left side panel 34, bottom panel 36, and top panel 38. The front panel 28 and the back panel 30 are of equal length and are proportionally larger than the right side panel 32 and the left side panel 34. The bottom panel 36 and the top panel 38 are of equal size. The inside top of the bottom panel 36 is the base for the computer system hardware. The top panel 38 is mounted to the inside of the front panel 28 with two spring adjustable hinges 26 to allow for ease of access to the computer system hardware 40. The top panel 38 can be placed in the horizontal position and locked in place to prevent unwarranted access. The top panel 38 can be adjusted via the two spring adjustable hinges 26 to an open forty five degree position. This position allowing for ease of access to computer system hardware for maintenance/repair purposes. The desk body 24 side panels and back panels have access openings for the neccessary computer system hardware 40. The desk body 24 is supported by four adjustable legs 42. The adjusable legs 42 allow for user ergonomic preferences.

Figure 2:
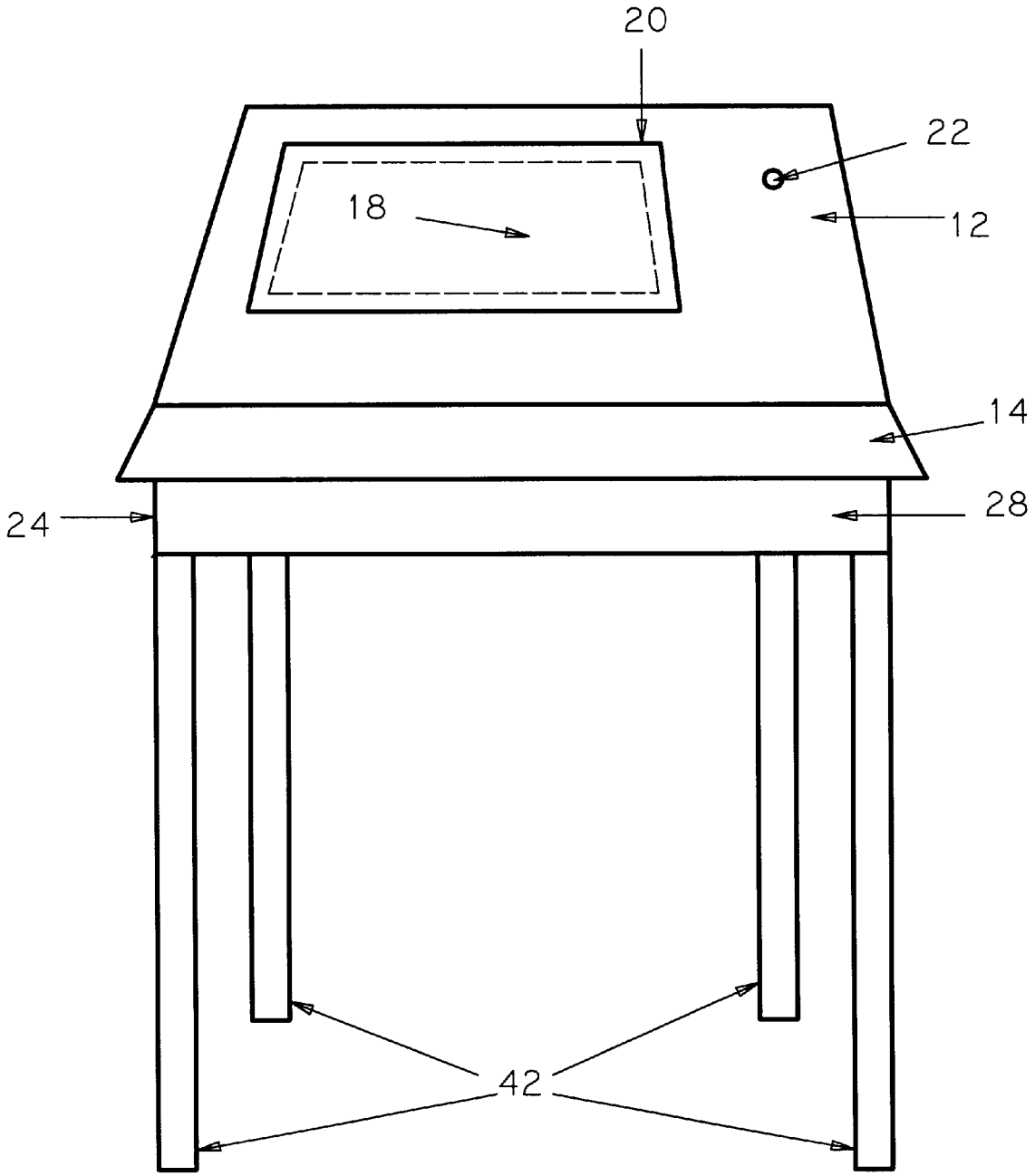
FIG. 2 is a perspective view depicting the front of the adjustable desk top with recessed flat panel screen with mouse access port and adjustable keyboard tray.

FIG. 2 is a perspective overview of the front of the desk. The front being the position the user would be located to use the desk. The desk top 12 is pictured in the inclined position for better visibility of the flat panel screen 18 and proper ergonomic positioning of the user. The mouse access port 22 is located in the to top right hand corner of the desk top 12. The flat panel screen 18 can easily be seen through the view panel 20. The flat panel screen 18 and view panel 20 are located in the desk top 12. The view panel 20 is flush with the top of the desk top 12 to provide an uninterruptable surface on which the user can perform traditional paper and pencil tasks. The keyboard tray 14 is in the open position for the user to use the computer keyboard that is either attached permanently or temporarily to the keyboard tray 14. The temporary attachment of a keyboard may be preferable is some school/home settings where the teacher or parent may want to restrict computer access to the user. The keyboard tray 14 is adjustable from a perpendicular closed position to a full ninety degree open position. The positioning of both the desk top 12 and the keyboard tray 14 depends on user ergonomic preference. The front panel 28 of the desk body 24 shown underneath the open keyboard tray 14. The entire desk is supported by four legs 42 that are entirely adjustable depending on user preference. The legs 42 are adjusted via a single set screw in each leg. The set screw is a star design to prevent unwanted adjustment my mischevious users.

Figure 3:
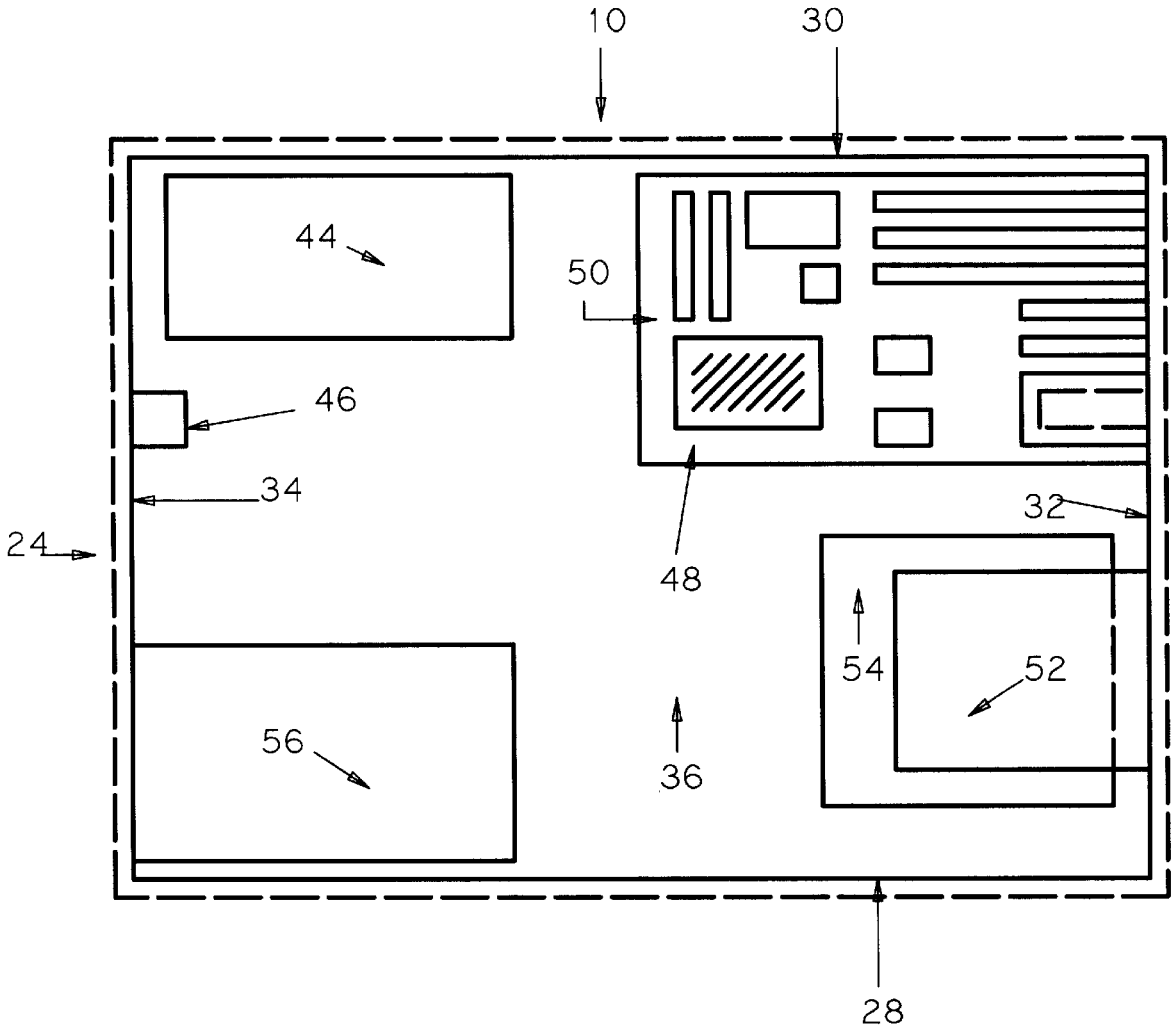
FIG. 3 is a top down view detailing the interior configuration of the selected computer components.

FIG. 3 is a top down view detailing the interior configuration of the computer in a desk 10 and of the installed computer components. The diagram is arranged with the back panel 30 located toward the top of the page and the front panel 28 is toward the bottom of the page. The computer power supply 44 is located at the left back of the desk body 24 and is attached to the desk body 24 bottom panel 36 with sheet metal screws. The power supply 44 cooling fan and electrical access ports are exposed via the back panel 30. The power supply 44 has an on/off switch 46 that is placed in the left side panel 34 closest to the back panel 30. The power supply 44 cabling necessary to power the computer components is routed along the inside of the desk body 24. The computer motherboard 48 is located at the right back of the desk body 24 and is attached to the bottom panel 36 with plastic and/or brass stand-offs. The expansion cards 50 are placed in the computer motherboard 48 with the access ports for the expansion cards 50 exposed via the right side panel 32 closest to the back panel 30 of the desk body 24. The floppy disk drive 52 and hard drive 54 are piggy-backed toward the front of the desk body 24 closest to the front panel 28. The floppy disk drive 52 sits atop the hard drive 54 in a sheet metal frame that is attached to the desk body 24bottom panel 36 with sheet metal screws. The piggy-backed drives are situated to allow sufficient air flow for cooling purposes. The hard drive 54 is an completely internal component therefore an access port in the desk body 24 right side panel 32 is unnecessary. The cd-rom drive 56 is placed in the left front of the desk body 24 closest to the front of the left side panel 34. The drive door of the cd-rom drive 56 is exposed via the left side of the front panel 28 closest to the left side panel 34.

Figure 4:
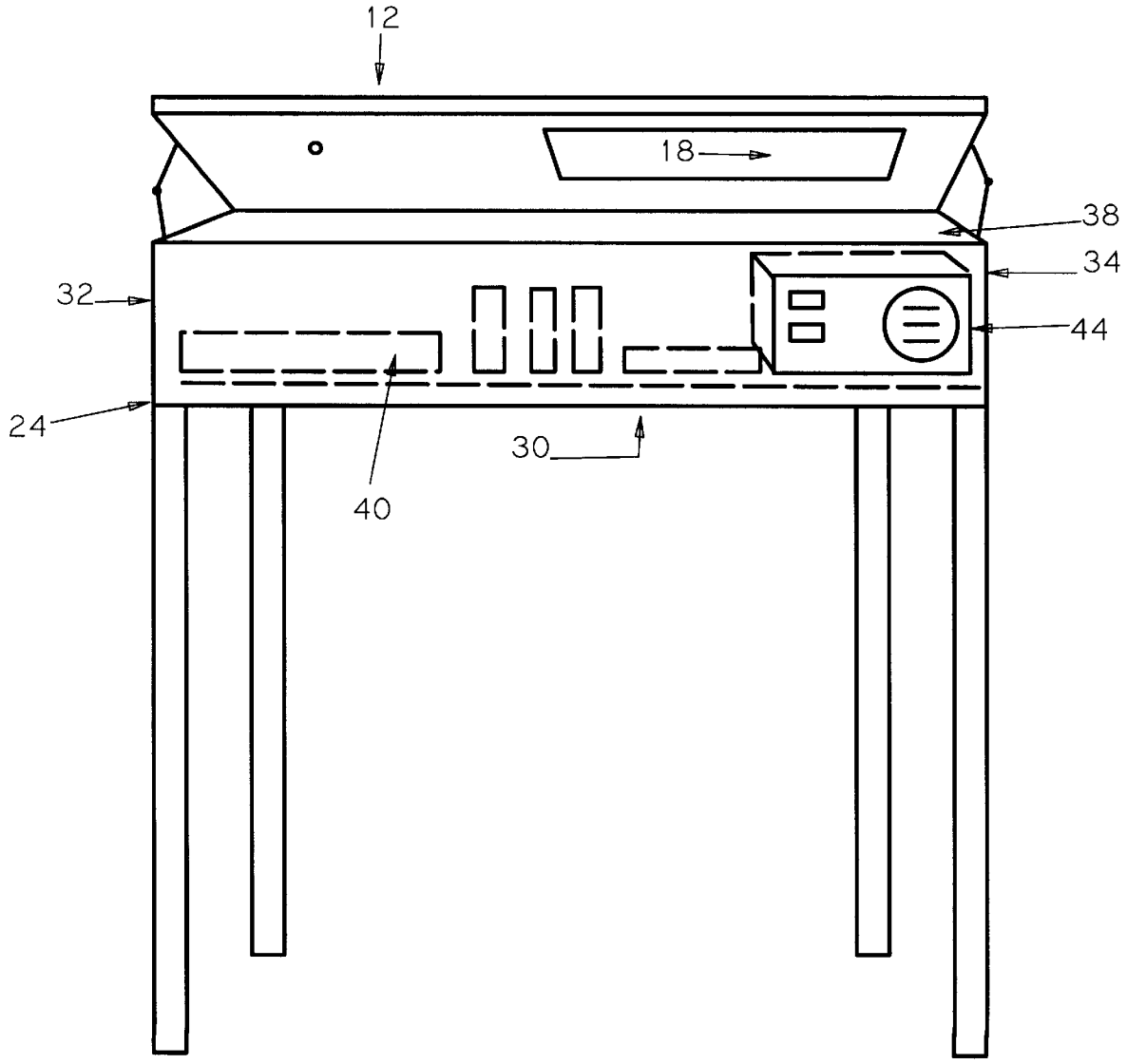
FIG. 4 is a perspective view of the back of the desk body and adjustable desk top with main access power supply.

FIG. 4 is a perspective view of the back of the desk body 24 and adjustable desk top 12 with the power supply 44 located on the far right side of the back panel 30. The power supply 44 is the main power source for the computer system hardware 40 located in the desk body 24 as well as for the flat panel screen 18. The desk top 12 is in a slightly elevated position allowing the user to view the flat panel screen 18. The computer system hardware 40 is protected by a top panel 38 that is slightly recessed in the top of the desk body 24. The top panel 38 is attached to the top of the right side panel 32 and the top of left side panel 34. The desk body 24 is depicted with four adjustable support legs 42.

Figure 5:
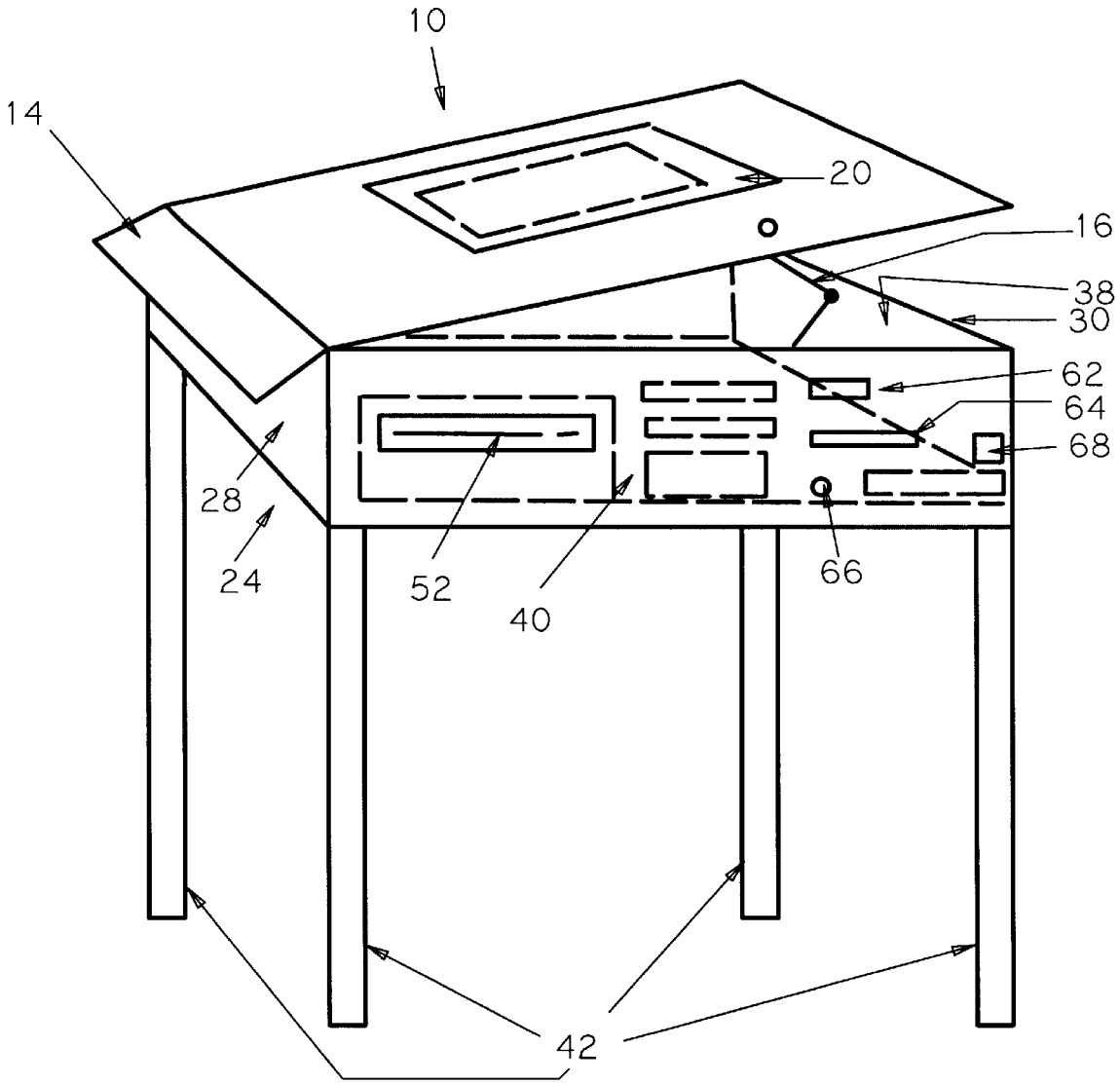
FIG. 5 is a a perspective view of the right side panel of the desk body with adjustable desk top and key board tray.

FIG. 5 is a perspective view of the right side panel 32 of the desk body 24 and the top panel 38 and keyboard tray 14. The front of the computer in a desk 10 is to the left in the diagram or the side with the adjustable keyboard tray 14 and the front panel 28 of the desk body 24. The right side panel 32 has access ports for computer system hardware 40. The left side of the right side panel 32 houses the floppy disk drive 52. The floppy disk drive 52 is centered vertically in the right side panel 32. The serial port 62, parallel port 64 and ps/2 mouse port 66 are centrally located in the right side panel 32. The computer system hardware 40 reset button 68 is located near the back panel 30. The reset button 68 is centered vertically in the right side panel 32. The top panel 38 with the recessed view panel 20 is depicted in an elevated position. The top panel 38 is supported via two adjustable support brackets 16. The keyboard tray 14 is in an open and usable position. The top panel 38 is attached to the desk body 24 and is depicted in the sealed or closed postion to protect the computer system hardware 40 from dust, dirt, and user interference. The sealed desk body 24 also provides for proper ventilation of the computer system hardware 40. The computer in a desk 10 is supported via four adjustable support legs 42.

Figure 6:
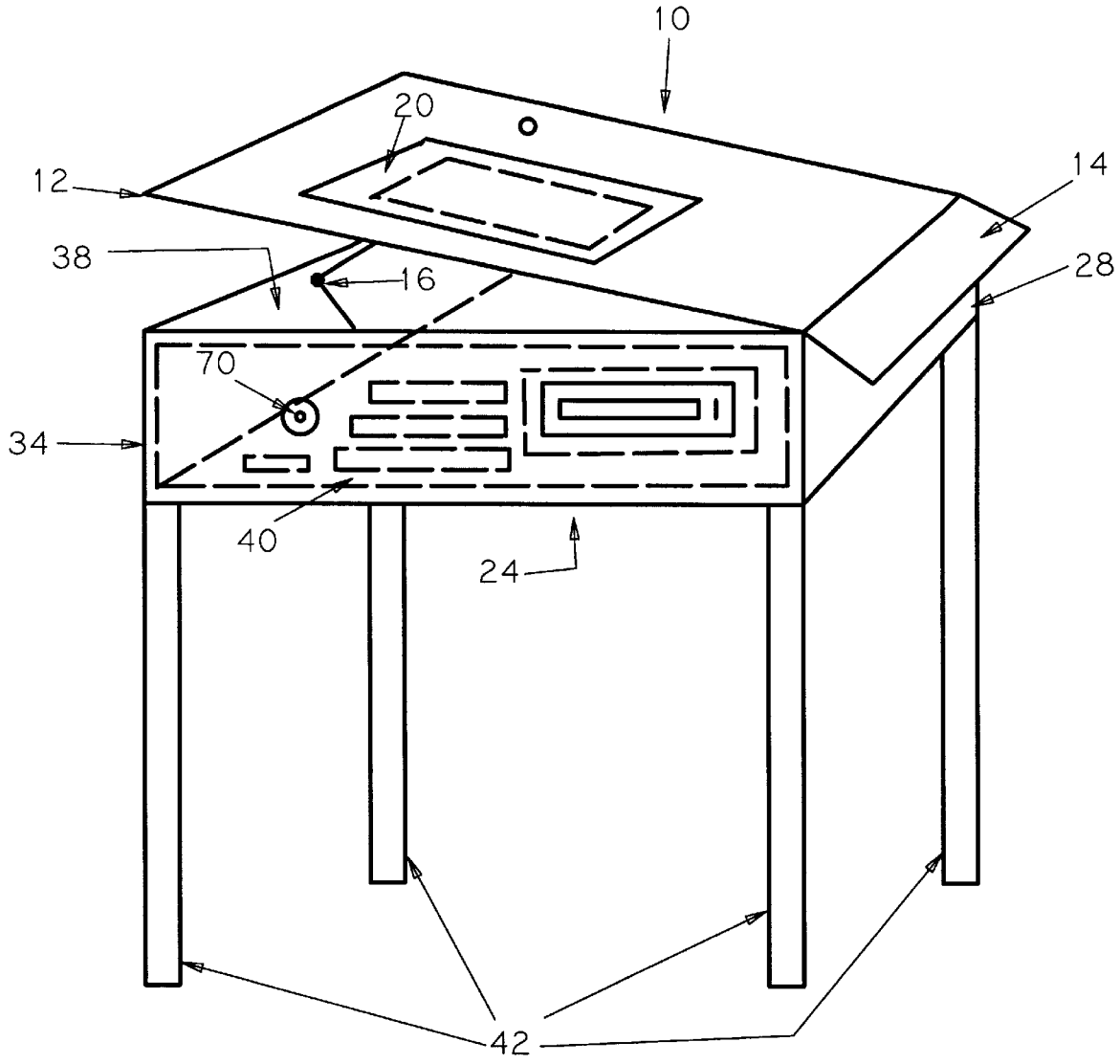
FIG. 6 is a perspective view of the left side of the desk body with adjustable desk top and keyboard tray.

FIG. 6 is a perspective view of the left side panel 34 of the desk body 24 with adjustable desk top 12 and keyboard tray 14. The front of the computer in a desk 10 is to the right in the diagram or the side with the adjustable keyboard tray 14 and the front panel 28 of the desk body 24. The left side panel 34 has access ports for computer system hardware 40. The left side of the left side panel 34 depicts a vertically centered power button 70. The power button 70 is used to turn on or off the computer system hardware 40. The right side of the left side panel 34 houses the vertically centered cd-rom drive 56. The desk top 12 with the recessed view panel 20 is depicted in an elevated position. The desk top 12 is supported via two adjustable support brackets 16. The keyboard tray 14 is in an open and usable position. The top panel 38 is attached to the desk body 24 and is depicted in the sealed or closed postion to protect the computer system hardware 40 from dust, dirt, and user interference. The sealed desk body 24 also provides for proper ventilation of the computer system hardware 40. The computer in a desk 10 is supported via four adjustable support legs 42.

PREFERRED EMBODIMENT—OPERATION

The operation of the device of the present invention will be described further with reference to FIGS. 1, 2, 4, 5, and 6.

The main operation of the computer in a desk 10 is that of a personal computer commonly used throughout homes, businesses and schools worldwide. FIGS. 1, 2, 4, 5, and 6 depict the computer in a desk 10 in the proper position for the user to use the computer. The keyboard tray 14 is in an angled and extended postion. The operation of the keyboard tray 14 depends on two spring adjustable hinges 26 secured to the bottom of the keyboard tray 14 and the top, front side of the desk body 24 front panel 28. The exact postion of the keyboard tray 14 is determined by the ergonomic needs of the user. The keyboard tray 14 can be elevated to a full parallel postion to the floor or it can be moved down to a vertical position perpendicular to the floor. The user can place the keyboard tray 14 in any desirable postion within the ninety degree angle provided by the two spring adjustable hinges 26. The computer keyboard can be attached to the keyboard tray 14 or easily removed and stored elsewhere. The keyboard tray 14 is narrow enough to prevent accidental damage to the computer keyboard either by a users knee or when the user pushes in a chair. The easy removal of the computer keyboard will prevent unwanted user access and/or accidental or intentional damage when the keyboard tray is in the vertical, closed position. This removal of the keyboard may be a necessary procedure especially in a classroom setting.

FIGS. 1, 2, 4, 5, and 6 all show the computer in a desk 10 with attached legs 42. The four legs 42 attached to the bottom panel 36 of the desk body 24 are adjustable to provide a level work surface and an ergonomic "fit" for the user. It's best if two people adjust the legs 42 of the computer in a desk 10. One person will support the desk body 24 while the other will adjust each of the legs 42 to the desired length. Each of the legs 42 is designed with a telescoping, adjustable portion that is easily and safely moved up or down by releasing a set screw and then sliding a portion of the leg either in or out of the main body of the legs 42. This adjustment is usually done once and is performed in conjunction with a supervising adult or teacher. Once adjusted the user can easily and comfortably move up to the computer in a desk 10 and using one or both hands extend the keyboard tray 14 to a comfortable angle for computer use. The user has the option of leaving the keyboard tray 14 in its vertical or closed position and using the desk for traditional paper and pencil activities. The keyboard tray 14 in its closed position does not inhibit the user in anyway when he uses the computer in a desk 10 for the traditional activities.

FIGS. 1, 2, 4, 5, and 6 depict the computer in a desk 10 with the desk top 12 in a position suitable for computer use. The desk top 12 has a range of user needs adjustment from a "closed" horizontal position parallel to the floor to a full "open" forty-five degree position. The user will generally use the horizontal position of the desk top 12 for the traditional paper and pencil activities. Although the installed flat panel screen 18 would be viewable and usable in this "closed" position. The angle of the flat panel screen 18 in this position might cause the user to sit closer to the desk body 24 wherein the use of the keyboard tray 14 might be inhibited. The ideal viewing angle is determined by the user who must take into consideration the obstruction of the keyboard tray 14 if the proper ergonomic adjustments are not made. Adjusting the desk top 12 is done with the support brackets 16 depicted in FIGS. 1, 4, 5, 6. Again, proper adjustment is determined by the user and can be done alone. The user simply places his left hand on the left side of the desk top 12 and his right hand on the right side of the desk top 12. The user then presses lightly on the adjustable support brackets 16 and either lowers or raises the view panel 20. The user cannot accidently drop the view panel 20 nor elevate it beyond its maximum viewing point. This is done with support brackets 16 that are ratcheted and have installed stop mechanisms. These support brackets 16 are commonly found in any local hardware store. These support brackets 16 are an integral part of providing a desk that can be safely used after minimal instruction by all ages.

At the core of the computer in a desk 10 is a state-of-the-art personal computer. FIGS. 1, 2, 3, 4, 5, and 6 all show the various parts of the personal computer. Operation of the computer depends on user level of computer training and sophistication. FIG. 1 depicts an overview of the entire computer in a desk 10 with the desk top 12 and the keyboard tray 14 all in the adjusted and ready positon for powering up the personal computer components. FIG. 2 shows the view panel 20 that covers the flat panel screen 18 that is one of the main interfaces between the user and the computer. FIG. 2 shows the mouse access port 22 through which a mouse may be routed. This device along with the keyboard tray 14 with computer keyboard and flat panel screen 18 are all user/computer interfaces. FIG. 4 shows the installed power supply 44 that is necessary for providing the power for the installed computer components. FIG. 5 shows the right side panel 32 of the desk body 24 with the easily accessible floppy disk drive 52, serial port 62, parallel port 64, reset button 68, and ps/2 mouse port 66. FIG. 6 shows the left side panel 34 of the desk body 24 with the easily accessible on/off switch 46 and cd-rom drive 56.

The extent to which the user uses the computer in a desk 10 all depends on user needs, understanding and knowledge of how to use a personal computer. The computer in a desk 10 is the type of simple plug-and-go device that our "go fast" society demands. A parent or school system can setup and have running a desk top personal computer in the time it takes to plug in its power supply. There are virtually no cables to attach; no wires to hook-up; no extra money to spend on a separate desk on which to place the computer. And better yet, it's portable. The light weight, adjustable and compact design allows for a quick move from one room, building or classroom to another. School systems with ever increasing numbers of students and yearly budgeting constraints can create virtual computer lab/classrooms with the purchase of the computer in a desk 10. In the past, school systems would buy the traditional school desk for a teachers classroom. Then they would build and supply a school computer lab at many times the cost of outfitting the teachers classroom with the computer in a desk 10. The economic, social and education value of the computer in a desk 10 will far out perform the traditional "buy the computer and then figure out where it will go." The computer in a desk 10 solves all of these problems.

Conclusions, Ramifications, and Scope

Accordingly, the reader will see that the computer in a desk 10 provides the advantages of both a normal desk and a computer desk. However, more importantly, this combination computer/desk is much more useful than having two separate desks, one for traditional use and one for computer use, because many personal computers are used as tools to help with traditional activities. Therefore it is important to have a desk that can simultaneously support both uses in a single, integrated space. When computer equipment is not in use the entire desk top is at a comfortable height for writing and other traditional paper and pencil activities. The single action of the adjustable keyboard tray 14 and desk top 12 make using the installed computer equipment easy to access and use. Furthermore, even when the desk is adjusted for computer use it can still be used for traditional paper and pencil activities.

The computer in a desk 10 provides additional advantages in that

1. It is a cost effective way to bring computer technology into every classroom and home. Schools, as well as parents, operate under budgetary constraints. The fact that the computer in a desk 10 is an integrated unit simplifies the logistics of having to purchase a separate computer desk for a standard computer system. Schools will not need to build and supply separate computer labs for students and staff saving thousands of the taxpayers dollars. The classroom will transform into a technological and traditional learning center where the students and staff will have the world at their fingertips. Parents will not need to purchase a separate desk on which to place their computer equipment saving them hundreds of dollars.

2. It is a space saving device. Every home and school has spacing considerations when purchasing computer equipment. The computer in a desk 10 is built using the standard classroom student desk found in schools worldwide. The size and dimensions facilitate placement of the desk (s) in a classroom as well as most any room in a consumers home.

3. It is a time saving device. Most schools have computer labs into which the computers in the school are centralized in one room. This creates a logistics problem for teachers whereby they must physically move their classes to the computer lab to do computer work. This movement of students from one room to another seriously disrupts the educational process. The computer in a desk 10 eliminates this movement by providing the students a desk in their classroom that functions as a computer as well as a traditional desk. Therefore the educational process is enhanced by the use of the computer in a desk 10.

4. It is a device that can quickly and easly be adjusted to suit the ergonomic needs of the user and can readily be used with a minimum of preparation. Students with accessibility handicaps will benefit from the computer in a desk 10 as well as the non-handicapped student. Ease of adjustment and ample room to work on and around the desk make the computer in a desk 10 a perfect learning tool for any school and/or home.

5. It is a device that seals the computer within the desk body 24 to prevent unwanted tampering as well as provide proper ventilation and cooling for the internal components. Many of the problems associated with computers arise from unwarranted tampering by children. The top panel 38 attached to the desk body 24 prevents this from happening. Proper cooling and venting of the internal components prevents contaminants from entering the system prolonging the sensitive computer circuitry.

6. It is a device that provides a work area for traditional paper and pencil activities in conjunction with or in addition to a computer related activities.

Although the description above contains many specificities, these should not be construed as limiting the scope of the invention but as merely providing illustrations of some of the presently preferred embodiments of this invention. Various other embodiments and ramifications are possible within it's scope. For example:

1. The computer in a desk 10 can be used in a commercial setting where a sealed desk/computer environment will prevent dust and dirt from being introduced into the computer system either by the user or the environment in which it is used.

2. The computer in a desk 10 can be attached to an existing network or can be networked in and of themselves. This will greatly benefit a school system financially and educationally whereby a networked classroom can be attached to a single networked printer, centralized server and/or internet.

3. The computer in a desk 10 can be retrofitted with wheels on the legs 42 to facilitate portablility. A hospital could provide patients with a computer in a desk 10 that can be wheeled from room to room and adjusted to their specific needs. A hotel could provide its customers with a full computer system and work area that can easily be moved from one room to another. Furthermore, commercial institutions and businesses can provide portable workstations for their employees.

4. The computer in a desk 10 is a sound educational device for the learning disabled or educationally challenged children and adults. Having a device that serves a users computer as well as traditional paper and pencil needs helps focus and center the individual. Having an individual's traditional and technological needs addressed by the computer in a desk 10 prevents unnecessary distraction or disruption of the educational process.

5. The computer in a desk 10 is designed for ease of maintenance and upgrade. The top panel 38 is easily actuated for normal system maintenance or upgrade of computer system components. This feature enables schools and consumers to retrofit and maintain the computer in a desk 10 for years to come with a conservative budgetary impact.

Thus the scope of the invention should be determined by the appended claims and their legal equivalents, rather than by the examples given.

What is claimed is:

1. A computer in a desk module, comprising in combination:

(a) a rectangular desk top having front, rear and side panels; the side panels are equal in length but shorter than the front and rear panels; the front and rear panels are equal in length but longer than the side panels; the desk top having an opening therein with adjustable support brackets attached to the desk top and side panels;

(b) a transparent view panel supported in the top surface of the desk top covering the opening;

(c) a front and back panel adjoining the side panels respectively;

(d) a bottom panel and top system panel adjoining front and rear panels; and left and right side panels respectively;

(e) four adjustable legs attached to the bottom panel in each respective corner;

(f) a keyboard tray supported via two spring adjustable hinges attached to the top front of the front panel portion of the desk top;

(g) a computer/monitor compartment bounded by the desk top, the front and back panels, the side panels, and the bottom panel, and top system panel;

(h) a computer system motherboard, expansion cards, power supply, disk drives, and flat panel screen contained therein.

2. The computer in a desk module of claim 1 wherein the view panel is rectangular and is offset closer to the left side panel in relation to the right side panel and left side panel and centered in relation to the front panel and back panel.

3. The computer in a desk module of claim 1 wherein the view panel is flush with the upper surface of the desk top.

4. The computer in a desk module of claim 1 wherein the desk top houses a flat panel screen beneath the view panel.

5. The computer in a desk module of claim 4 wherein the flat panel screen is attached to bottom surface of the top panel by a plurality of supporting brackets.

6. The computer in a desk module of claim 1 wherein the computer system hardware is place within the desk body.

7. The computer in a desk module of claim 6 wherein the computer system hardware is attached to the top of the bottom panel of the desk body with plastic standoffs and retaining screws.

8. The computer in a desk module of claim 1 wherein the keyboard tray is attached to the front panel with two spring adjustable hinges to allow the keyboard tray to be pivoted between a stored and/or usable position.

9. The computer in a desk module of claim 4 wherein the desk top with flat panel screen and view panel is suspended by two support brackets attached to the bottom of the left and right outside edges of the desk top and to each of the left and right side panels; and attached to the inside top of the front panel and the inside bottom of the desk top closest to the front panel via two spring adjustable hinges.

10. The computer in a desk module of claim 9 wherein the two support brackets and two spring adjustable hinges attached to the desk top allow for adjustment from a horizontal position of the desk top to a maximum 80 degree incline allowing for proper screen viewing and/or ergonomic requirements of the user.

11. The computer in a desk module of claim 1 wherein the left side panel has access ports for power on/off push button switch and for a cd-rom drive.

12. The computer in a desk module of claim 1 wherein the right side panel has access ports for floppy disk drive, serial port, parallel port, ps/2 mouse port, network device, modem and reset button.

13. The computer in a desk module of claim 1 wherein the back panel has access ports for power supply, and for the routing and circulating of air for proper computer system cooling.

14. The computer in a desk module of claim 1 wherein the top panel has an access port for proper routing of mouse cable.

* * * * *